US005897001A

United States Patent [19]

Dembicks

[11] Patent Number: 5,897,001

[45] Date of Patent: Apr. 27, 1999

[54] LOCKING HOLDER FOR INTERCHANGEABLE BIT MEMBERS WITH ACCESSORY DISPLAY UNIT

[76] Inventor: Andrew E. Dembicks, 5308 Boca Marina Cir. North, Boca Raton, Fla. 33487

[21] Appl. No.: 08/798,616

[22] Filed: Feb. 11, 1997

Related U.S. Application Data

[63] Continuation-in-part of application No. 08/530,767, Sep. 19, 1995, Pat. No. 5,725,107, and a continuation-in-part of application No. 08/726,459, Oct. 4, 1996, Pat. No. 5,715, 951.

[51] Int. Cl.[6] ..... A47F 5/00

[52] U.S. Cl. ..... 211/70.6; 211/89.01; 211/94.01; 206/378

[58] Field of Search ..... 211/70.6, 94.01, 211/89.01; 248/309.1, 309.2, 222.52, 222.13; 206/378, 493

[56] References Cited

U.S. PATENT DOCUMENTS

| | | | |
|---|---|---|---|
| 4,019,632 | 4/1977 | Greenlee | 206/378 X |
| 5,154,544 | 10/1992 | Arendt | 206/378 X |
| 5,715,951 | 2/1998 | Dembicks | 211/70.6 |
| 5,725,107 | 3/1998 | Dembicks | 211/70.6 |

*Primary Examiner*—Robert W. Gibson, Jr.
*Attorney, Agent, or Firm*—Quarles & Brady

[57] ABSTRACT

An apparatus is disclosed for the secure storage of sockets for ratchet wrenches. The invention includes a system for securely holding one or more of a set of detachable bits, used with ratchet wrenches or other tools, by means of a cam-actuated rotator member mounted within a channel guide. Further, a novel display apparatus is disclosed which provides a secure mounting system for a ratchet wrench together with a set of sockets. Finally, a extension arm system is provided for attaching an accessory device such as an extension bar to the apparatus so that the ratchet wrench, sockets and accessory may be conveniently stored and displayed together.

14 Claims, 9 Drawing Sheets

LOCKING HOLDER FOR INTERCHANGEABLE BIT MEMBERS WITH ACCESSORY DISPLAY UNIT

CROSS REFERENCE TO RELATED APPLICATIONS

This application is a continuation-in-part of U.S. application Ser. No. 08/530,767, filed Sep. 19, 1995, now U.S. Pat. No. 5,725,107 and a continuation-in-part of U.S. application Ser. No. 08/726,459, filed Oct. 4, 1996, now U.S. Pat. No. 5,715,951

STATEMENT REGARDING FEDERALLY SPONSORED RESEARCH OR DEVELOPMENT (Not Applicable)

BACKGROUND OF THE INVENTION

1. Technical Field

The present invention relates to the secure packaging of ratchets, sockets for ratchet wrenches, and ratchet extensions for merchandising and storage.

2. Description of the Related Art

Ratchet wrenches of the kind which are used by professional and amateur mechanics commonly include a gripping handle integrally formed with a ratchet head unit. The ratchet head unit generally includes a male sexed ratchet drive nub operationally connected to a reversible ratchet mechanism positioned within the ratchet head. Detachable sockets are available for use with such ratchets which include a drive aperture dimensioned to receive male sexed ratchet drive nubs of certain standard sizes. For example, standard sized drive nubs may be ¼, ⅜ or ½ inches square. On an opposite end of the socket there is typically provided a second aperture designed to securely engage a nut or the head of a bolt. To aid in the use of such tools, it is often helpful to make use of a ratchet accessory item. Such an accessory item may be an extension bar, a knuckle connector or some other item for use in connection with ratchets and sockets.

It is often desirable to store a series of sockets for ratchet wrenches in an organized manner so that various socket sizes for use with different size nuts and bolts may be easily located. Systems of the prior art for storing such sockets have included elongated metal rack systems with resilient male-engaging members for engaging the drive end of a socket to be stored thereon. Significantly, however, such systems suffer from a serious drawbacks in that, if they are dropped on the floor or roughly handled, sockets mounted thereon will tend to be knocked off the rack, and thereby become disorganized. Furthermore, such systems typically suffer from corrosion problems due to the necessity of manufacturing such items from metal. To date, no economical and commercially available socket-storage systems have been available which have overcome the problem of securely holding a socket in a convenient, releasable manner.

Likewise, for the purposes of merchandising and maintaining tools in an organized manner, it is often useful to be able to store a ratchet wrench with a set of sockets. In the case of merchandising displays, the positioning of a ratchet wrench with a set of sockets promotes sales of the units as a set. It also provides a neat, organized package which can be easily stocked. For similar reasons, it is helpful to be able to sell a ratchet accessory with a set of sockets. Finally, in order to provide a more compact and attractive looking display, it is useful when storing a ratchet wrench with a set of sockets, to store the sockets on a rack which is elongated so that it follows the basic elongated shape of the ratchet wrench handle. In this way, the amount of display area required is minimized for the combination ratchet wrench and socket set. Of course, for reasons of appearance, it is important that the ratchet wrench handle be aligned in parallel with the elongated rack.

Thus, it would be desirable to provide a secure merchandising device for displaying a set of sockets together with a ratchet wrench.

It would also be desirable to provide a secure merchandising device for displaying a set of sockets together with a ratchet wrench, and which can further be used by a consumer as a convenient storage rack after purchase.

It would also be desirable to provide a secure merchandising and storage rack for a set of sockets, a ratchet wrench and a ratchet accessory.

SUMMARY OF THE INVENTION

It is an object of this invention to provide a secure merchandising device for displaying a set of sockets together with a ratchet wrench.

It is a further object of this invention to provide a secure merchandising device for displaying a set of sockets together with a ratchet wrench, and which can further be used by a consumer as a convenient storage rack after purchase of same.

It is still a further object of the invention to provide a secure merchandising and storage rack for a set of sockets, a ratchet wrench and a ratchet accessory.

These and other objects are accomplished by the present invention which provides a novel and commercially-attractive system for the merchandising and storage of ratchet wrenches, sockets, and ratchet accessory items. The storage rack can be economically manufactured using injection molding and extrusion techniques.

The combination holder according to the invention is comprised of a rotator member, a channel guide and a cap unit. The rotator member base is preferably formed with an eccentric cam surface defined on its outer periphery which includes at least two parallel opposing cam-locking faces. The parallel opposing cam-locking faces are provided for maintaining the rotator member in a rotationally stationary locking position relative to the channel guide means. The rotator member is designed to securely receive a socket on a socket receiving member end thereof, opposite from said eccentric cam surface, when the rotator member is in its locking position. The socket receiving member is joined to the rotator member base by means of a lower body. The channel guide is provided for receiving the base portion of the rotator member in a manner permitting rotation and lateral sliding of the rotator member within the guide. The channel guide includes opposing channel side walls formed parallel to one another, and projecting upwardly along the length of an elongated channel base. A retaining lip is defined on a upper edge of each of the side walls, protruding inwardly toward a center line of the channel guide, for retaining the base portion of the rotator member in position between the side walls.

Minor variations with respect structure for locking the rotator member are possible. For example, rather than being rotationally locked when the two parallel opposing cam locking faces of the base engage the side walls of the channel, the invention can be designed so that only one of the opposing cam locking faces engages a side wall, and a section of the lower body portion engages a lip of an opposing channel side wall.

The cap unit is designed to interfit in a locking engagement with the channel on one end thereof. The cap unit preferably includes a display rack engaging structure, such as a bore, for receiving a rod from a display rack therein. In addition, the cap unit includes a rotatable ratchet drive nub engagement member, which preferably has an axis of rotation transverse to the length of the channel. The rotatable ratchet engagement member is configured to lockingly receive a ratchet drive nub therein, and can rotate freely relative to the cap unit. In this way, when a ratchet drive nub is inserted into the rotatable ratchet member, and the combination holder is suspended by a display rack rod, the ratchet wrench will be suspended vertically, in parallel to the guide channel, for neat and compact appearance.

BRIEF DESCRIPTION OF THE DRAWINGS

FIG. 14(*b*) is a cross sectional view of the cap unit mounted in the channel guide with a ratchet wrench shown in phantom lines.

FIG. 15(*b*) is a cross-sectional view of the cap unit main body in FIG. 15 taken along line b—b.

DETAILED DESCRIPTION OF THE INVENTION

Figure 1:
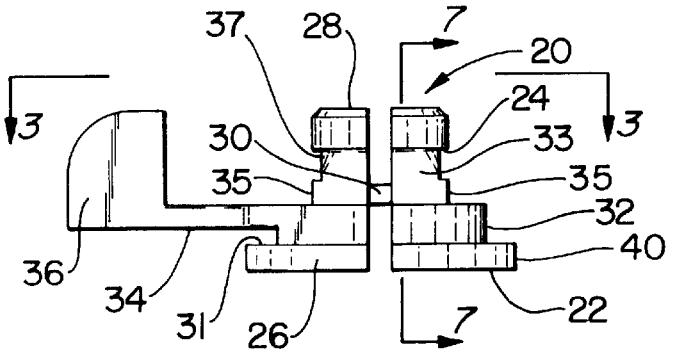
FIG. 1 is a side elevation view of a first embodiment of the rotator member according to the invention.
Figure 2:
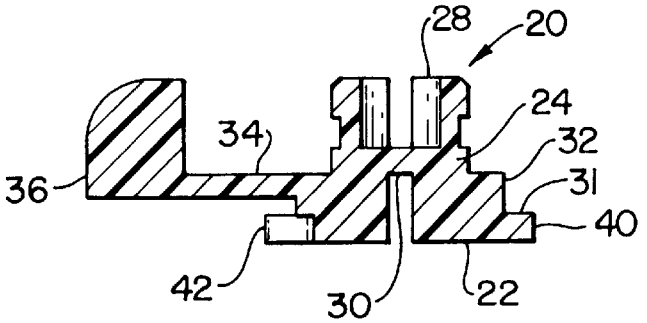
FIG. 2 is a sectional view of the rotator member taken substantially along line 2—2 in FIG. 3.
Figure 3:
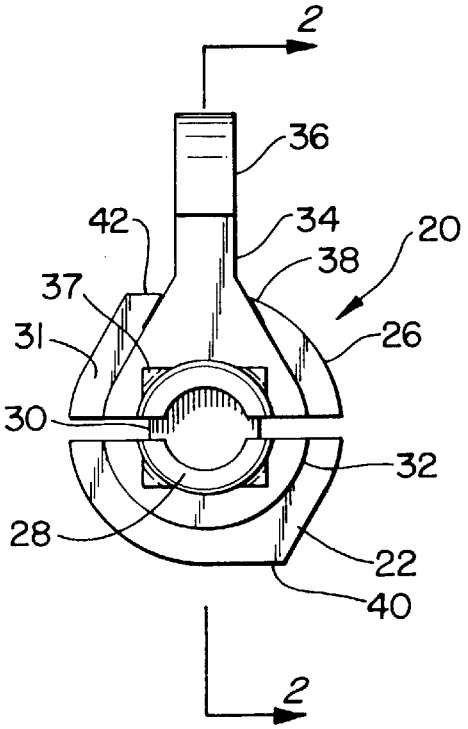
FIG. 3 is a top view of the rotator member.

As shown in FIGS. 1–10, a socket holder system is disclosed which includes a rotator member 20, and a channel guide 44. The rotator member 20 includes a flattened or planar base section which includes an eccentric cam surface 26 formed on its outer periphery. The eccentric cam surface is radially non-symmetric about a central axis defined as passing transversely through the planar surface of base 22. On the top surface of the base 22 is formed a lower body 32 which is approximately cylindrical in shape. The cylindrical lower body 32 has a diameter which is smaller than the diameter of the smallest imaginary circle which could be drawn completely inside the perimeter of the base 22. Further, the circular perimeter defined by the lower body 32 is inwardly offset from the perimeter of the eccentric cam surface 26 such that a shoulder 31 is defined on the upper surface of the base 22 which is bounded by the outer cylindrical surface of the lower body 32. On an upper surface of the cylindrical lower body, a socket-receiving member 24 is formed. Socket receiving member 24 is comprised of a box member 33 formed on an upper surface of the cylindrical lower body, which box section is advantageously dimensioned to inter-fit with a standard drive aperture formed on a socket. Typically, the box member will be dimensioned to snugly nest within a ¼", ⅜" or ½" square drive aperture formed on a socket for a wrench, as is well known in this industry.

In a preferred embodiment, a cylindrical alignment head 28 is provided on top of the box member 33. Cylindrical alignment head 28 is preferably dimensioned to have a diameter approximately equal to each of the sides forming box member 33. In this manner, the cylindrical alignment head may be fitted in a socket drive aperture to align the axis of the socket aperture with the box member. A bevel 37 is preferably defined on each of the upper corners of the box member to assist in guiding a socket drive aperture past the cylindrical alignment head and onto the box member 33. Further, a box member lip 35 is preferably formed on at least two opposing side walls forming the box member to more securely engage a socket drive to be mounted on the socket receiving member 24.

The socket-receiving member 24, cylindrical lower body 32 and box member 33, according to the invention, are divided along the central axis of the rotator member, so as to form two opposing sides separated by a gap. The base 22, socket-receiving member 24 and cylindrical lower body 32 are joined together by a resilient bridge member 30, which connects the opposing sides of the rotator member 20. In a preferred embodiment, the resilient bridge member 30 is formed at approximately the mid-point along the axial length of the rotator member, just above the cylindrical lower body 32. However, the invention is not so limited, and the bridge member may be positioned slightly above or below the axial mid-point.

A rotator arm 34 may be provided attached to the rotator member 20 to assist in allowing the rotator member to be manually rotated on its axis. A paddle member 36 is preferably provided on the rotator arm for conveniently grasping of the arm by a user. It should be noted however that the primary purpose of the rotator arm is to provide the user with a mechanical advantage in rotating the rotator member about its axis. In the case where a sufficiently large diameter socket or other bit member is mounted on the socket receiving member, the socket itself may provide sufficient mechanical advantage for rotating the rotator member so that the rotator arm may be eliminated. For the purpose of clarity, the invention as described herein will include reference to a rotator arm.

According to the invention, the rotator member 20 is positioned within channel guide 44 as shown in FIGS. 7–10. As shown if FIGS. 5 and 6, the channel guide is comprised of an elongated channel base 46, upon which are mounted opposing channel side walls 48, which are parallel and spaced from one another along the length of channel guide 44. At an upper edge of channel side walls 48, a channel-retaining lip 50 is formed which projects inwardly from each of the channel side walls toward a center line defined along the length of the channel guide 44.

Figure 7:
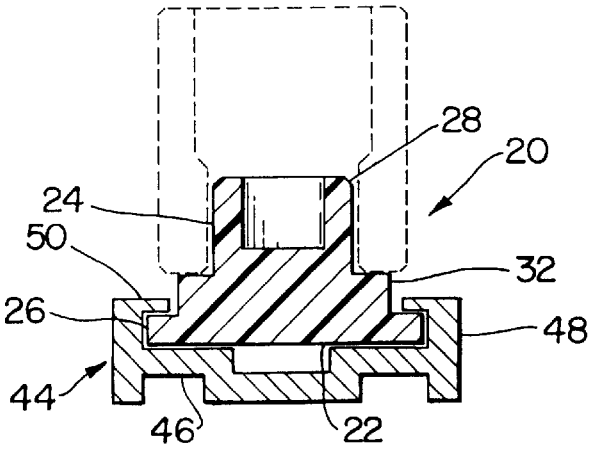
FIG. 7 is a sectional view of the rotator member taken along line 7—7 in FIG. 1, shown positioned in the channel guide.
Figure 8:
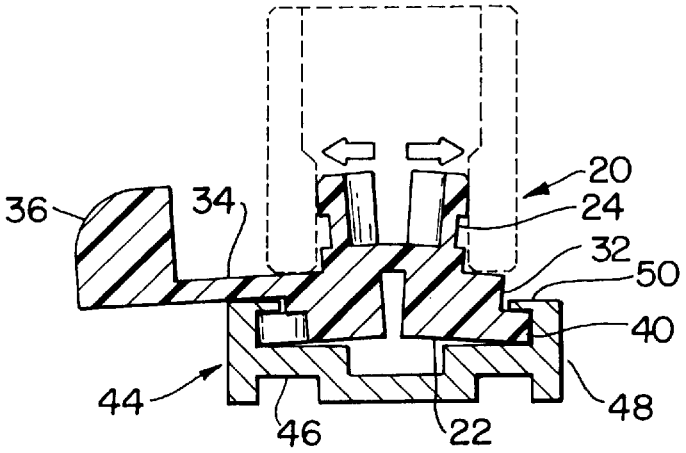
FIG. 8 is a sectional view of the rotator member taken along line 2—2 in FIG. 3, shown positioned within the channel guide in its locked or engaged position.

As shown in FIGS. 7 and 8, shoulder 31 engages channel-retaining lip 50 when the rotator member 20 is positioned within the channel guide 44. In this manner, rotator member 20 may rotated axially, or may slide along the length of channel guide 44, but is otherwise retained therein. The channel side walls 48 are advantageously spaced from one another a distance sufficient to permit rotator member 20 to rotate within the channel guide, but will cause the channel side walls to engage specifically-defined portions of the eccentric cam surface 26.

Figure 4:
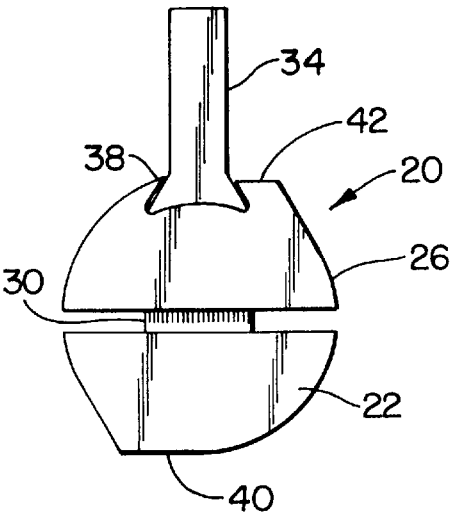
FIG. 4 is a bottom view of the rotator member.
Figure 5:
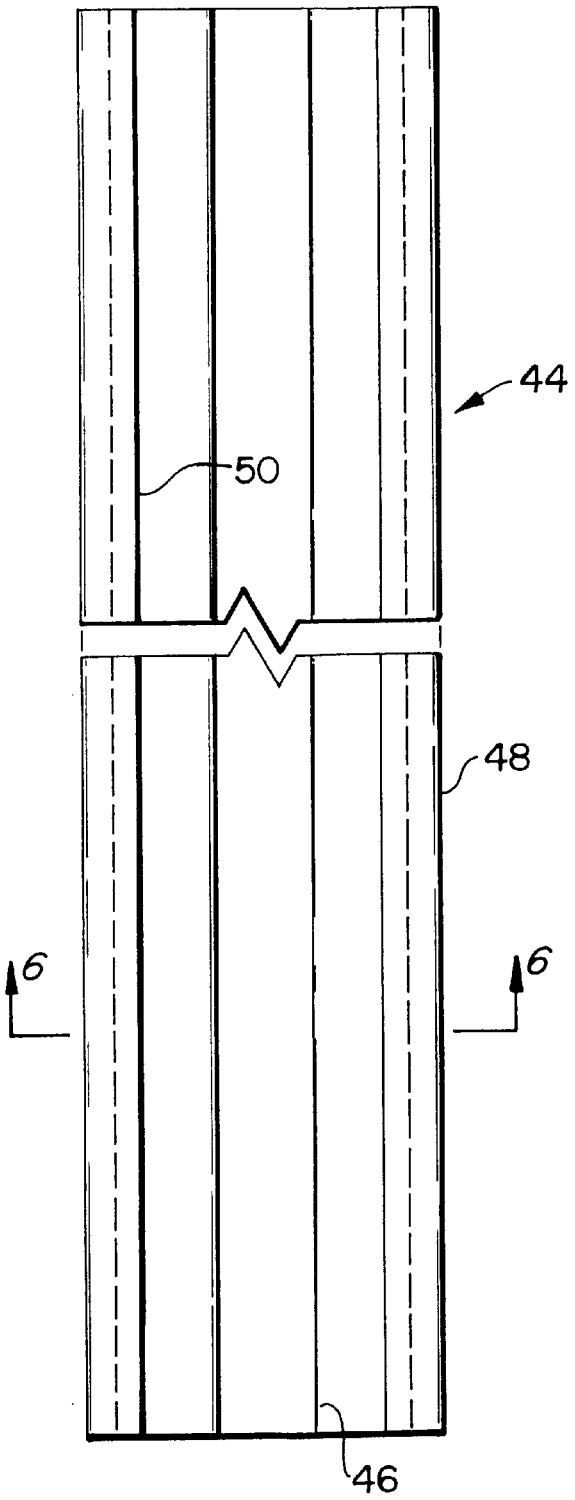
FIG. 5 is a top view of the channel guide with the channel side walls shown in phantom.
Figure 6:
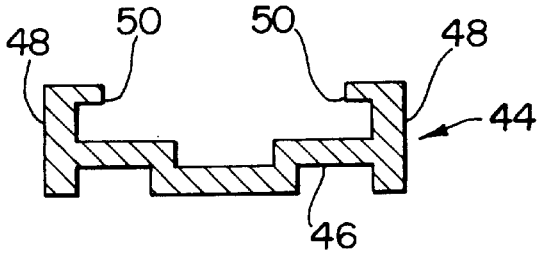
FIG. 6 is a sectional view of the channel guide taken along line 6—6 in FIG. 5.
Figure 9:
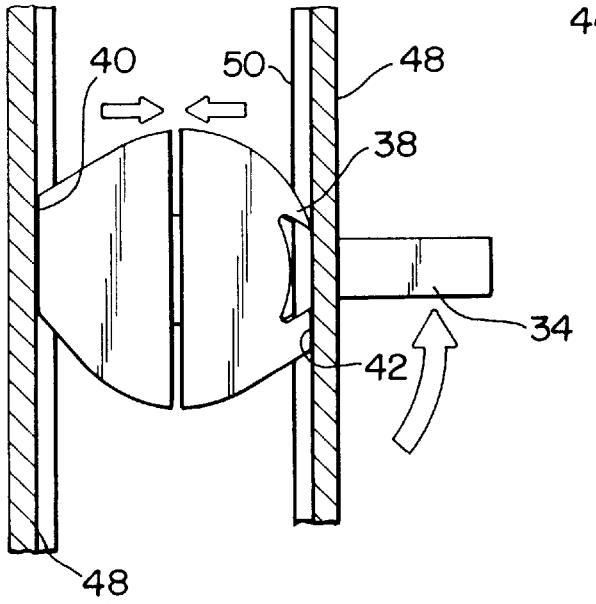
FIG. 9 is a bottom view of the rotator member shown positioned in the channel guide in a locked or engaged position.
Figure 10:
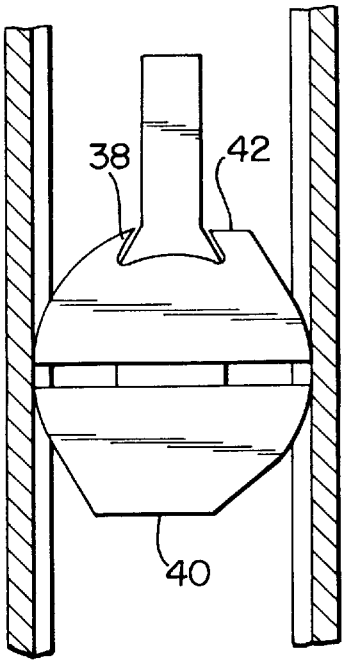
FIG. 10 is a bottom view of the rotator member shown positioned in the channel guide in an unlocked position.

As shown in FIGS. 4, 9 and 10, the eccentric cam surface includes primary cam-locking face 40 and secondary cam locking face 42. The primary and secondary cam-locking faces are oriented such that their surfaces are parallel to one another and to the gap separating the opposing sides of the rotator member. Further, the cam locking faces are positioned substantially on opposite sides of the eccentric cam surface. Finally, a resilient edge member 38 is provided as shown in FIG. 4.

According to the invention, when rotator member 20 is positioned as shown in FIGS. 7 and 10, primary cam-locking face 40 and secondary cam-locking face 42 do not engage channel side walls 48 and the rotator member will be in its unlocked position for receiving a socket. By comparison, when the rotator member is pivoted about its central axis in the channel guide to the position as shown in FIGS. 8 and 9, so that primary cam-locking face 40 and secondary cam-locking face 42 engage channel side walls 48, the opposing sides of base 22 will be compressed inwardly toward the central axis. As a result of such compression, the opposing sides of the socket-receiving member 24, located above the resilient bridge member, will be forced outwardly from one another as shown in FIG. 8. The outward movement of the opposing sides of the socket-receiving member 24 causes the outer surface of the box member 33 and cylindrical alignment head 28 to engage the interior side walls of a socket drive aperture to be retained on the socket holder system.

Further, according to the invention, resilient edge member 38 is provided to render a spring-like detent. The resilient edge member assists in maintaining the rotator member in its locked position as shown in FIG. 9, once it has been placed in that position. As can be seen from FIG. 9, the spring pressure of resilient edge member 38 is directed against side wall 48 to resiliently inhibit movement of the rotator member 20 when its positioned as shown in FIG. 9. Further, edge member 38 provides resilience necessary to allow rotator member 20 to disengage from the position shown in FIG. 9 when it is rotated in a clockwise direction to an unlocked position shown in FIG. 10. In particular, the manual rotational force in a clockwise direction, which is imparted by a user on rotator arm 34, will cause resilient edge member 38, to bend inwardly toward the central axis of the rotator member, so it may be disengaged from its locked position shown in FIG. 9.

Figure 11:
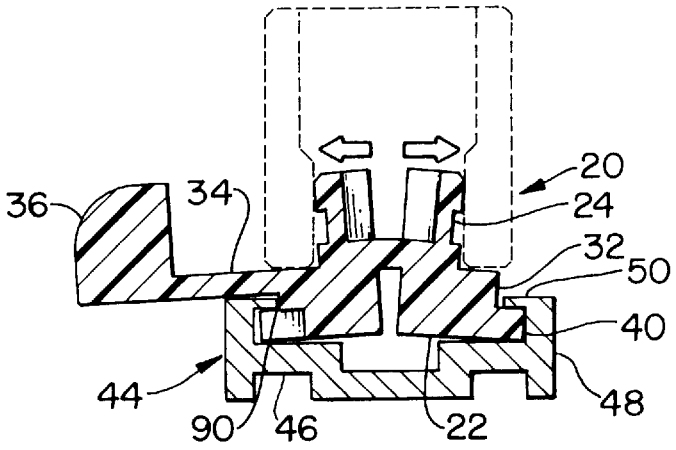
FIG. 11 is a sectional view of an alternative embodiment of the rotator member, shown positioned within the channel guide in its locked or engaged position.
Figure 12:
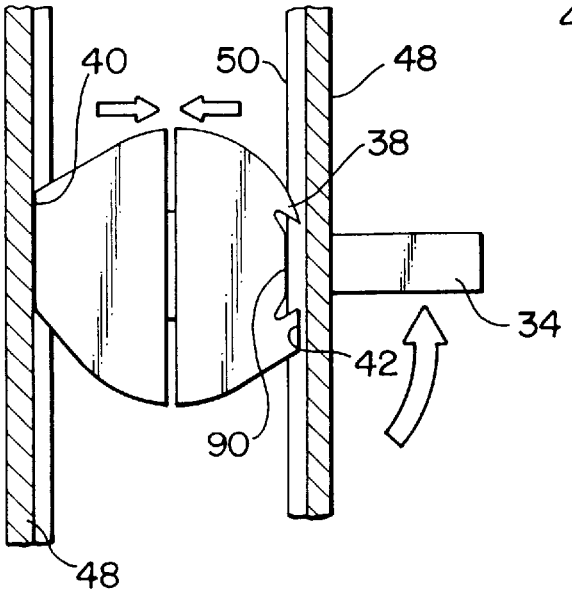
FIG. 12 is a bottom view of the rotator member shown in FIG. 11, positioned in the channel guide in an locked or engaged position.
Figure 13:
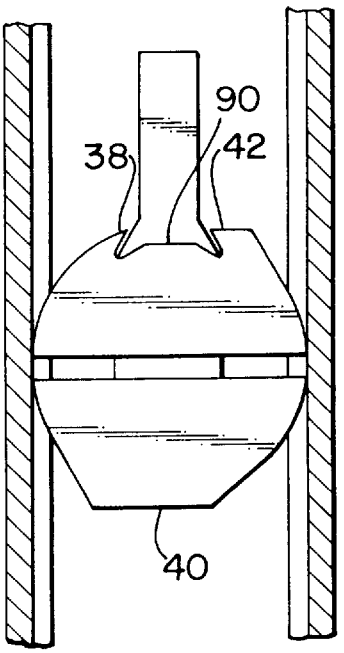
FIG. 13 is a bottom view of the rotator member shown in FIG. 11 positioned in the channel guide in an unlocked position.
Figure 18:
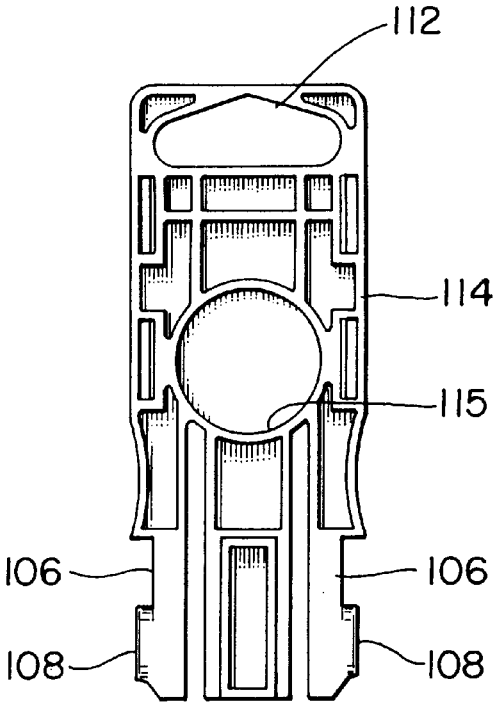
FIG. 18 is a bottom view of the cap unit main body shown in FIG. 15.
Figure 19:
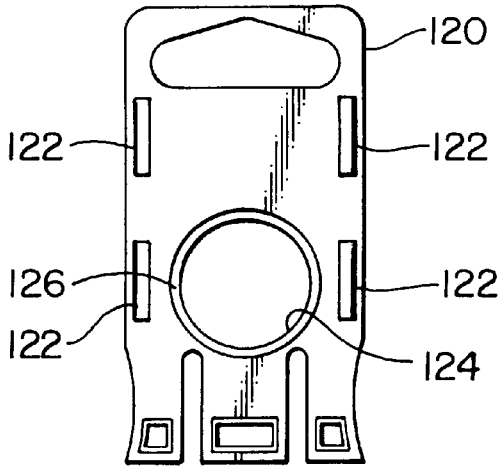
FIG. 19 is a top view of a cap unit cover-plate.

Minor variations are possible with respect to the invention as described above. For example, as shown in FIGS. 11–13, the invention can be designed so that instead of being rotationally locked when the two parallel opposing cam locking faces 40, 42 engage the side walls of the channel, such locking occurs when the primary cam locking face 40 engages a side wall, and a portion of the lower body 32 engages the retaining lip 50 of an opposing side wall. In such cases, it is preferred that the lower body 32 be formed with a bevel 90 which is parallel to the surface of primary cam locking face 40, as shown in FIGS. 18 and 19. In the embodiment of the invention shown in FIGS. 11–13, the secondary cam locking face 42 is not used for locking. However, the resilient edge member 38 functions as described above to provide a spring-like detent when the invention is rotated into its locked orientation.

Significantly, it should be noted that while FIGS. 7–10 and 11–13 illustrate two examples of the precise manner in which a rotator member as described herein, can interact with the channel guide 44, the invention is not so limited. The dimensions and configuration of the rotator member can be varied in any suitable manner to accommodate different engagements with the channel guide 44, so long as such engagement results in a compression of a lower portion of the rotator member sufficient to cause the socket receiving member 24 to deform and engage a bit.

Figure 14A:
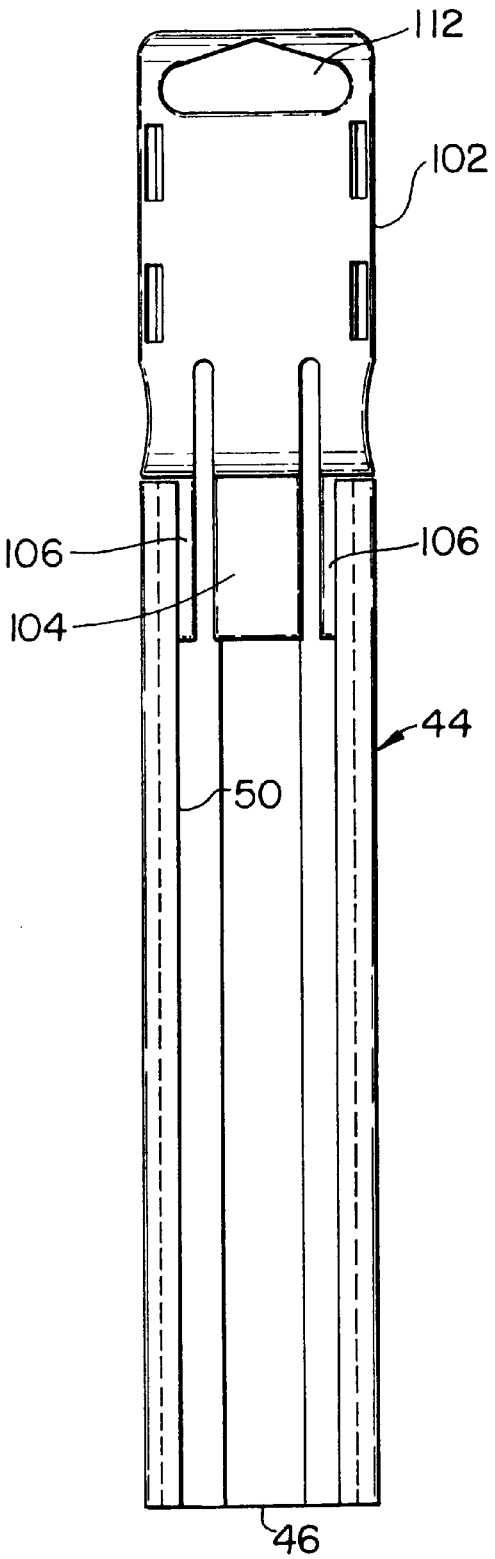
FIG. 14(*a*) is a top view of the channel guide with a cap unit mounted therein.
Figure 14B:
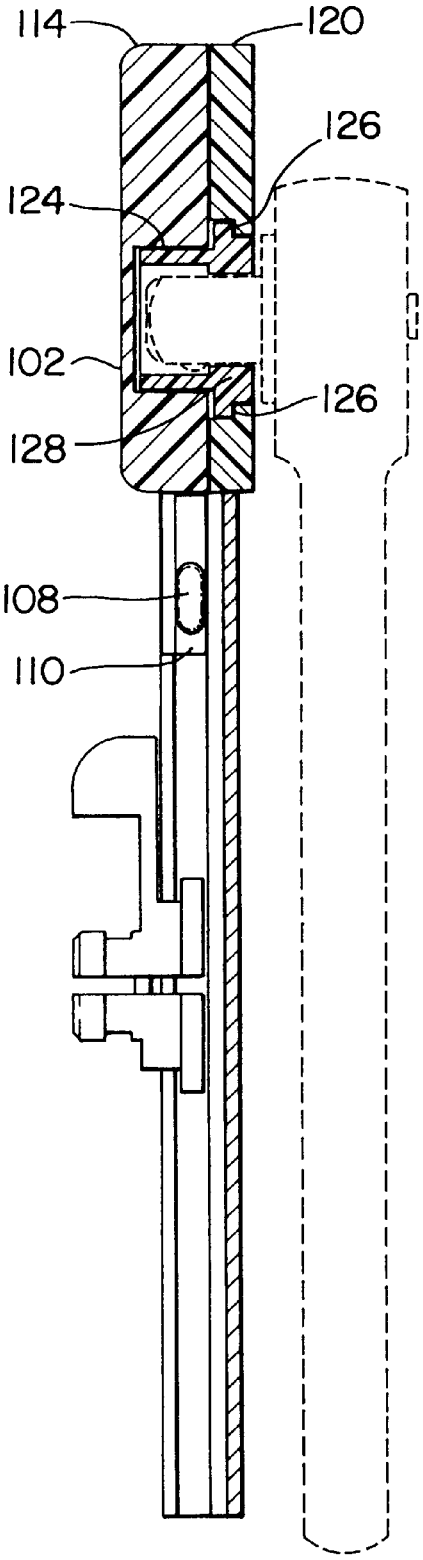
Figure 15A:
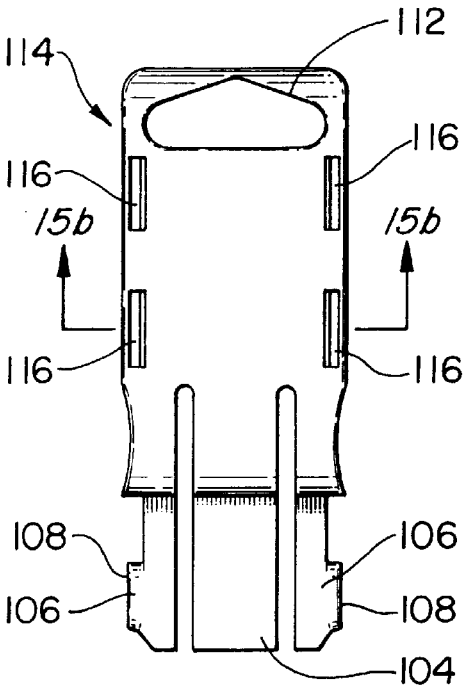
FIG. 15(*a*) is a top view of a cap unit main body.
Figure 15B:
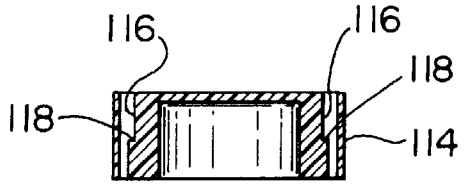
Figure 16:
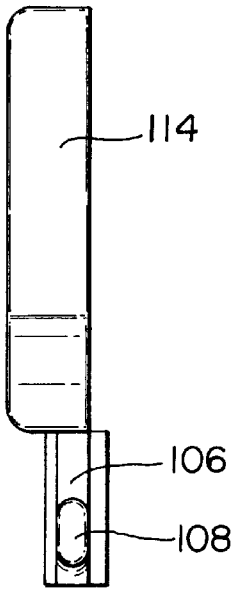
FIG. 16 is a side view of the cap unit main body shown in FIG. 15.
Figure 17:
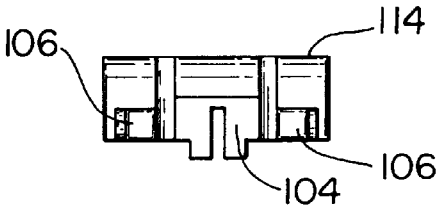
FIG. 17 is an end view of the cap unit main body shown in FIG. 15.

FIGS. 14(*a*) and (*b*) illustrate a further feature of the holder according to the present invention. As shown in FIGS. 14(*a*) and (*b*), a cap unit 102 is attached to the channel guide 44 at one end thereof by suitable means such as a snap lock connector 104. As shown in FIGS. 14(*a*) and (*b*), snap lock connector 104 is preferably comprised of tongue members 106 which interfit within the channel defined by the channel side walls 48 and elongated channel base 46. A nub 108 is provided on each of said tongue members for engaging a corresponding locking aperture 110 defined in each of the side walls 48. Other mounting means may also be used for attaching the cap unit 102 to the channel guide and it should be understood that the invention is not limited in this regard. The cap unit 102 preferably also defines a bore or channel 112 formed transverse to the elongated axis of the channel, for receiving therein a rod from a display rack.

Figure 20:
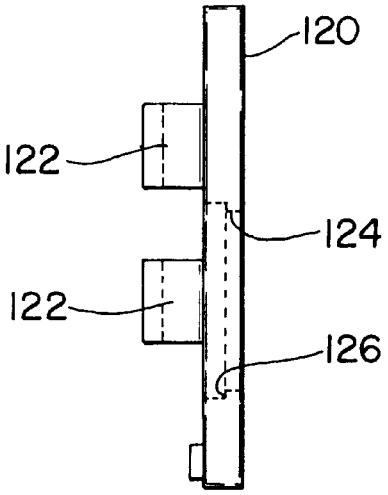
FIG. 20 is a side view of the cap unit cover-plate of FIG. 19.
Figure 21:
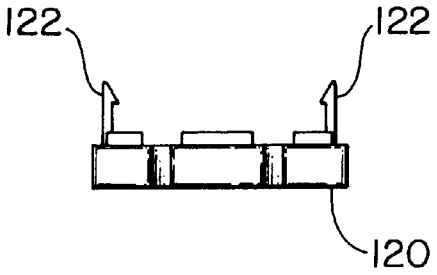
FIG. 21 is an end view of th cap unit cover-plate of FIG. 19.
Figure 22:
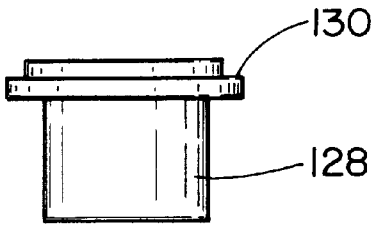
FIG. 22 is a side view of a cylindrical cap unit insert.
Figure 23:
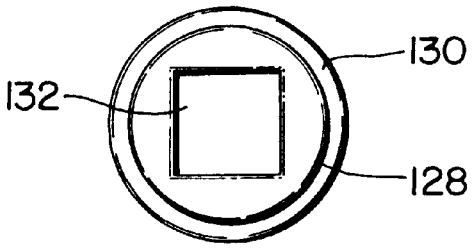
FIG. 23 is a top view of the cylindrical cap unit insert of FIG. 22.
Figure 24:
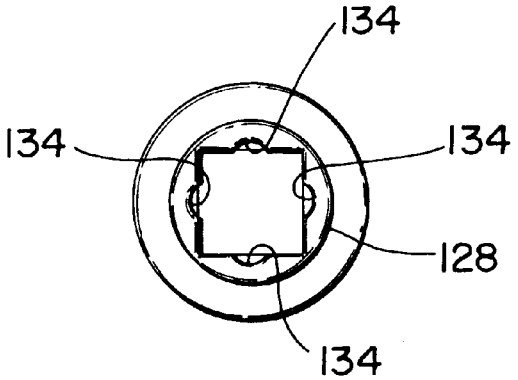
FIG. 24 is a bottom view of the cylindrical cap unit insert of FIG. 22.
Figure 25:
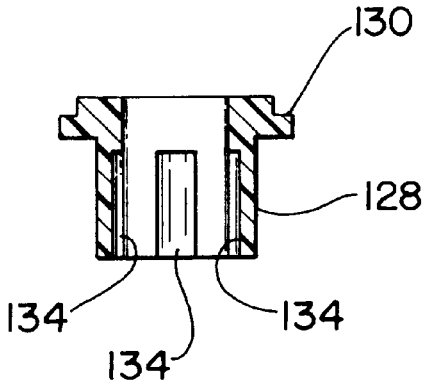
FIG. 25 is a cross-sectional view of the cap unit insert of FIG. 22.

In a preferred embodiment, the cap unit 102 is formed from two component parts as shown in FIGS. 15–21. In FIG. 15–18, a cap unit main body 114 is shown, which includes the snap lock connector 104 described above. The cap unit main body includes a cylindrical recess 115 for receiving a rotatable cap unit insert 128 therein. In addition, a set of snap-lock slots 116 are preferably provided. Each of the snap lock slots preferably includes a ridge 118 for lockingly engaging a corresponding tab 122 of a cap unit cover plate 120, as shown in FIGS. 19–21. Cap unit cover plate 120 also is provided with a stepped cylindrical bore 124 which defines a bearing lip 126. As best shown in FIG. 14(*b*), the cap unit insert 128 is preferably inserted within the cylindrical recess 115. With the cap unit cover plate 120 snapped into place, the cap unit insert 128 is rotatably secured 110 within the cylindrical recess 115 by the bearing lip 126.

As shown in FIGS. 22–25, the cap unit insert 128 is formed with a bearing lip 130 and an internal bore 132 for receiving a standard sized male sexed ratchet wrench drive nub. The internal bore 132 preferably has a square shaped cross-sectional profile for securely engaging a ratchet wrench drive nub. Further, the internal bore 132 is preferably provided with a series of detent channels 134 for lockingly engaging a spring-loaded ball mechanism which is commonly provided on ratchet wrench drive nubs. When a ratchet wrench drive nub is inserted within the internal bore 132 past a certain point, the spring loaded ball mechanism formed on the nub will engage one of the detent channels 134, and thereafter prevent the ratchet wrench from being removed from the internal bore until a release mechanism is engaged on the ratchet wrench.

FIGS. 14–25 illustrate a presently preferred embodiment of the cap unit according to the invention. However, it should be understood that the invention is not limited in this regard. Any specific arrangement can be used for the cap unit, provided that it is capable of being attached to the channel guide 44 and includes a rotatable cap unit insert for receiving a ratchet wrench. As illustrated in FIG. 14(*a*) and (*b*), when the cap unit is formed in this manner, the ratchet wrench drive nub may be securely engaged within the cap unit. Subsequently, when the holder according to the present invention is vertically mounted on a display rack, a ratchet wrench inserted within the cap unit insert will hang neatly behind the channel guide 44 in a vertical orientation, which is convenient for storage and display.

Figure 26:
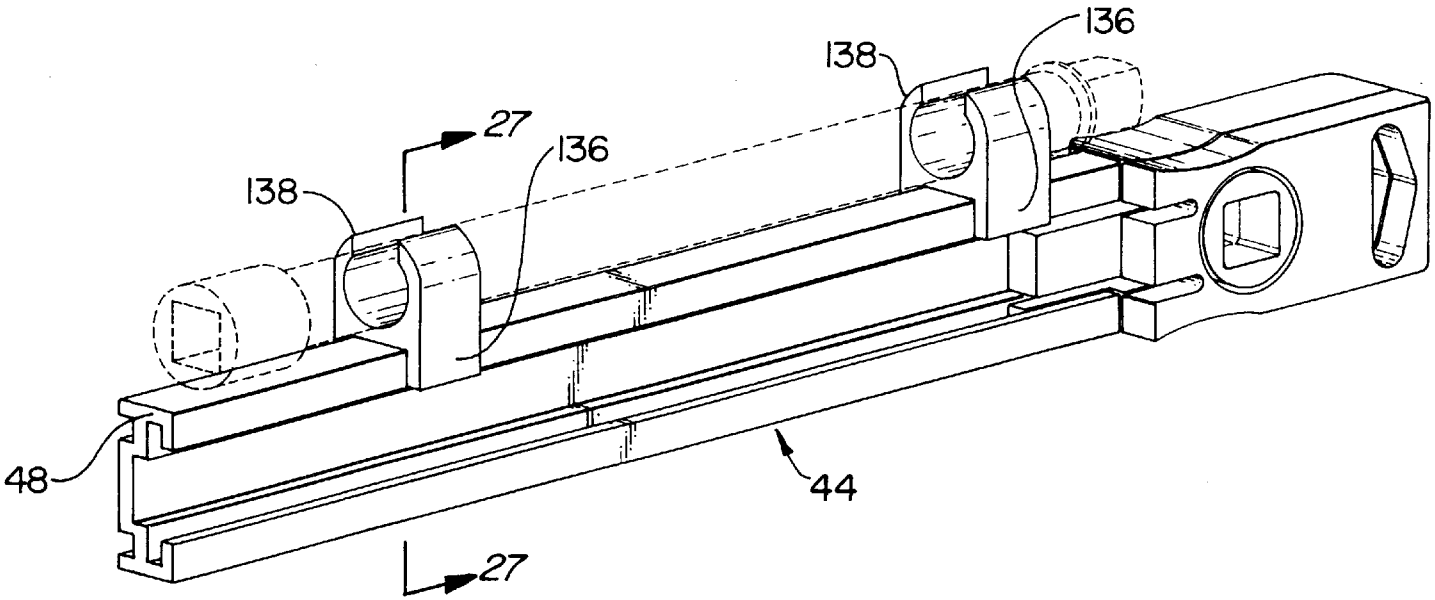
FIG. 26 is a perspective view of an extension arm for securing a ratchet wrench accessory to the channel guide.
Figure 27:
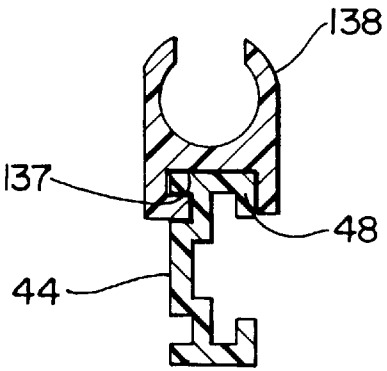
FIG. 27 is a cross-sectional view of the extension arm of FIG. 26, taken along line 27—27 in FIG. 26.

Finally, in FIGS. 26 and 27, extension arms 136 are preferably provided for securing a ratchet wrench accessory, such as an extension, with a set of sockets. Extension arms 136 preferably are formed with a profiled guide member 137 for slidingly engaging the side wall 48 of channel 44 as shown. The extension arms are configured so that they can slide onto one end of the channel 44 but engage the channel side wall with sufficient frictional force to retain their position once they have been guided into place. In this regard, it should be noted that alternative embodiments are also possible for attaching the extension arm 136 to the channel 44, and the invention is not limited in this regard. For example, instead of engaging only a single side wall of said channel, the extension arm 136 can be designed to extend from one side wall to an opposite side wall.

As shown in FIGS. 26 and 27, the extension arms 136 include resilient hands 138 which are preferably formed with a "C" profile for snap fit engagement with a ratchet accessory. In FIG. 26, a ratchet wrench extension is shown in phantom to illustrate the operation of the ratchet wrench accessory arms. The resilient hands 138 are preferably designed with a diameter which is approximately the same or slightly smaller than the diameter of the accessory tool to be grasped therein. Thus, when an accessory is to be inserted into the resilient hands 138 of the accessory arms, the body of the accessory is pushed against the open side of each of the hands 138. The force of the accessory against the open side of each of the hands causes them to expand slightly over the diameter of the tool body, after which the hands spring closed to hold the accessory in place. The "C" shaped profile for resilient hands 138 is presently preferred. However, the invention is not necessarily limited in this regard. In fact, any suitable clamping or locking member can be used for this purpose, depending upon the specific type of accessory to be attached to the channel guide.

I claim:

1. A combination holder system for compact storage of a ratchet wrench and a plurality of sockets for said wrench, said system comprising:

(a) a channel guide comprised of a pair of opposing channel sidewalls formed on an elongated channel base; and, (b) a plurality of uniformly-sized rotator members rotatably mounted within said channel guide and configured for locking engagement with at least one of said sockets when rotated to a locking position.

2. A combination holder system for compact storage of a ratchet wrench and a plurality of sockets for said wrench, said system comprising:

(a) a channel guide comprised of a pair of opposing channel sidewalls formed on an elongated channel base;

(b) a rotator member rotatably mounted within said channel guide and configured for locking engagement with at least one of said sockets when rotated to a locking position; and, (c) a cap unit, said cap unit attached to said channel guide at an end thereof and having a freely rotatable ratchet wrench engagement member mounted therein, said rotatable ratchet wrench engagement member configured for securely receiving a ratchet wrench drive nub.

3. The combination holder according to claim 2 wherein said ratchet wrench engagement member has an axis of rotation transverse to the lengthwise direction of said elongated channel base.

4. The combination holder according to claim 2 wherein said cap unit is further comprised of a display rack engagement structure formed on an end of said cap unit opposite from said channel guide, said display rack engagement structure defining an aperture in said cap unit configured for receiving a rod from a display rack therein.

5. The combination holder according to claim 2 further comprising an accessory holder, said accessory holder comprised of at least one extension arm having an extension arm body which is profiled to securely engage at least a portion of said channel guide for mounting thereon, and a hand for securely holding a ratchet wrench accessory item.

6. The combination holder according to claim 5 wherein said extension arm has a profiled guide for slidingly engaging said channel guide.

7. The combination holder according to claim 5 wherein said hand is formed from a resilient material and in a C-shaped profile, for resiliently engaging a ratchet wrench accessory.

8. A combination holder system for compact storage of a ratchet wrench and a plurality of sockets for said wrench, said system comprising:

(a) an elongated socket holder comprising a plurality of socket receiving members mounted on an elongated base, said socket receiving members configured for releasably securing a plurality of sockets; and (b) a cap unit, said cap unit attached to said elongated socket holder at one end thereof and having a freely rotatable ratchet engagement member mounted therein, said rotatable ratchet engagement member configured for securely receiving a ratchet wrench drive nub.

9. The combination holder according to claim 8 wherein said ratchet wrench engagement member has an axis of rotation transverse to the lengthwise direction of said elongated base.

10. The combination holder according to claim 8 wherein said cap unit is further comprised of a display rack engagement structure formed on an end of said cap unit opposite from said elongated base, said display rack engagement structure defining an aperture in said cap unit and configured for receiving a rod from a display rack therein.

11. The combination holder according to claim 8 further comprising an accessory holder, said accessory holder comprised of at least one extension arm having an extension arm body which is profiled to securely engage at least a portion of said elongated base for mounting thereon, and a hand for securely holding a ratchet wrench accessory item.

12. The combination holder according to claim 11 wherein said extension arm has profiled guide for slidingly engaging said elongated base.

13. The combination holder according to claim 11 wherein said hand is formed from a resilient material and in a C-shaped profile, for resiliently engaging a ratchet wrench accessory.

14. In a holder for compact storage of a ratchet wrench, a cap unit having a freely rotatable ratchet engagement member mounted therein, and a display rack engagement structure, said display rack engagement structure defining an aperture in said cap unit and configured for receiving a rod from a display rack along a display rod axis, said ratchet wrench engagement member having an axis of rotation which is parallel to and vertically aligned with said display rod axis.

* * * * *